US005636888A

United States Patent [19]

Kiser et al.

[11] Patent Number: 5,636,888

[45] Date of Patent: Jun. 10, 1997

[54] REMOTE-CONTROLLED LATCH ASSEMBLY

[75] Inventors: David G. Kiser, Franklin; David B. Allen, Linesville, both of Pa.

[73] Assignee: Drafto Corporation, Cochranton, Pa.

[21] Appl. No.: 370,646

[22] Filed: Jan. 10, 1995

[51] Int. Cl.[6] ..... B66C 1/36

[52] U.S. Cl. ..... 294/82.19; 294/82.3; 294/905

[58] Field of Search ..... 294/82.17, 82.19, 294/82.2, 82.21, 82.24, 82.3, 82.31, 82.33, 82.35, 905

[56] References Cited

U.S. PATENT DOCUMENTS

| | | | |
|---|---|---|---|
| 1,062,084 | 5/1913 | Desbecker . | |
| 1,524,761 | 2/1925 | Timbs . | |
| 1,525,292 | 2/1925 | Greve . | |
| 1,576,197 | 3/1926 | Kuffel et al. . | |
| 3,575,458 | 4/1971 | Crook, Jr. et al. | 294/82 |
| 3,633,960 | 1/1972 | Drayton | 294/905 |
| 4,073,531 | 2/1978 | Androski | 294/83 R |
| 4,077,661 | 3/1978 | Inahashi | 294/82.31 |
| 4,195,872 | 4/1980 | Skaalen et al. | 294/82 R |
| 4,416,480 | 11/1983 | Moody | 294/83 R |
| 4,569,548 | 2/1986 | Vaders | 294/905 |
| 4,691,584 | 9/1987 | Takaishi et al. | 74/471 R |
| 5,108,139 | 4/1992 | Leech | 294/82.17 |

FOREIGN PATENT DOCUMENTS

| | | | |
|---|---|---|---|
| 659-506 | 4/1976 | U.S.S.R. | 294/82.3 |

*Primary Examiner*—Dean Kramer

*Attorney, Agent, or Firm*—Webb Ziesenheim Bruening Logsdon Orkin & Hanson, P.C.

[57] ABSTRACT

A remote-controlled latch assembly having a latch plate assembly with a latch plate attached to a shank of a hoist hook. A latch is attached to the latch plate and is disposed across a throat of the hook. A latch operating assembly is also attached to the latch plate assembly and includes a drive motor for causing the latch to rotate to an open position. An electronics package, including a radio receiver, is disposed adjacent the drive motor and in electronic communication therewith. The operating assembly further includes an electrical power source for supplying electrical power to the electronics package and the drive motor.

22 Claims, 2 Drawing Sheets

REMOTE-CONTROLLED LATCH ASSEMBLY

BACKGROUND OF THE INVENTION

1. Field of the Invention

This invention relates generally to latches for hoist hooks and, more particularly, to a radio-controlled gravity latch assembly for a hoist hook.

2. Description of the Prior Art

In various construction and industrial applications, hoist hooks having some type of latch assembly are used to move large, heavy loads from one location to another. Generally, a latch located across the throat of the hook is manually retracted to open the throat of the hook and a bail or choker attached to the load is slipped on to the hook. The latch is then manually replaced to its original position to close the throat of the hook thus preventing the load from accidentally slipping off of the hook during transit. In normal circumstances, at least one and frequently two workmen are required to retract the latch from the hook throat and position the bail on the hook. Further, once the load has been moved to a new position, at least one workman is required to walk up to the hook and manually retract the latch to allow the load to be released. Thus, the attachment and release of the load to the hook pose safety hazards for workers who must manually open and close the latch to allow the load to be attached or released. In addition to the problem of personnel safety, a considerable amount of man-hours is lost by requiring workers to perform these duties manually.

An example of a typical prior art gravity-biased hook latch is shown in U.S. Pat. No. 1,525,292 to Greve. The Greve patent discloses a hook having a gravity latch pivotally located in the hook throat. The gravity latch has triangular-shaped sides and is pivotally mounted on the hook shank above the throat of the hook. The latch is normally biased in the closed position but can be manually retracted by a pair of handles.

To overcome the above-described shortcomings of manual latch assemblies, remote-controlled latches have been developed. U.S. Pat. No. 4,416,480 to Moody discloses a remote-controlled pneumatic release device for a rotatable hook. The hook is normally retained in a load carrying position by a latch pin engaged in a recess in an upper portion of the hook. A radio receiver, batteries, switch and solenoid valve are carried in a module located above the releasing hook. A signal from a portable radio transmitter is received by the radio receiver to close the switch and energize the solenoid valve. Actuation of the solenoid valve causes transmission of compressed air to the underside of the latch pin thus disengaging the latch pin from the hook and allowing the hook to rotate and release the load.

U.S. Pat. No. 4,073,531 to Androski discloses a radio-controlled safety hook assembly having a rotatable hook carried on a frame member. A battery, radio receiver, relay switch and motor gear assembly are located in a casing above the hook. A radio frequency from a portable transmitter is transmitted to the receiver which energizes the relay and actuates the motor. The motor turns a worm gear assembly which releases a safety latch and causes the hook to pivotally rotate to an open position. However, if power is lost while the hook is in the open position, it will remain open and must be manually closed. Other examples of hook latches and remote operators are disclosed in U.S. Pat. Nos. 1,062,084; 1,524,761; 1,576,197; 3,575,458; 4,195,872; 4,691,584; and 5,108,139.

The radio-controlled latch assemblies of the prior art are generally large, bulky, complex rotating hook arrangements which are difficult to manufacture and operate. Further, many of these prior art radio-controlled latch assemblies are difficult if not impossible to operate manually should they experience a loss of power. In addition, these prior art radio-controlled latch assemblies are generally not capable of being adapted for use with standard hoisting hooks.

Therefore, it is an object of the present invention to provide a compact, less complicated and more reliable radio-controlled latch assembly for engagement and disengagement of loads from hoisting hooks. Another object of the invention is to provide a radio-controlled latch assembly which, upon loss of electrical power, can still be easily and efficiently operated manually. A further object of the invention is to provide a radio-controlled latch assembly which can be easily installed and removed as a unit from a hoist hook.

SUMMARY OF THE INVENTION

A remote-controlled latch assembly of the present invention includes a latch plate attached to a shank of a hoist hook. A latch is attached to a latch plate and is disposed across a throat of the hook. The latch operating assembly is also attached to the latch plate and includes a drive motor for causing the latch to rotate to an open position. An electronics package, including a radio receiver, is disposed adjacent the drive motor and in electronic communication therewith. The operating assembly further includes means for supplying electrical power to the electronics package and the drive motor.

DESCRIPTION OF THE PREFERRED EMBODIMENTS

Figure 1:
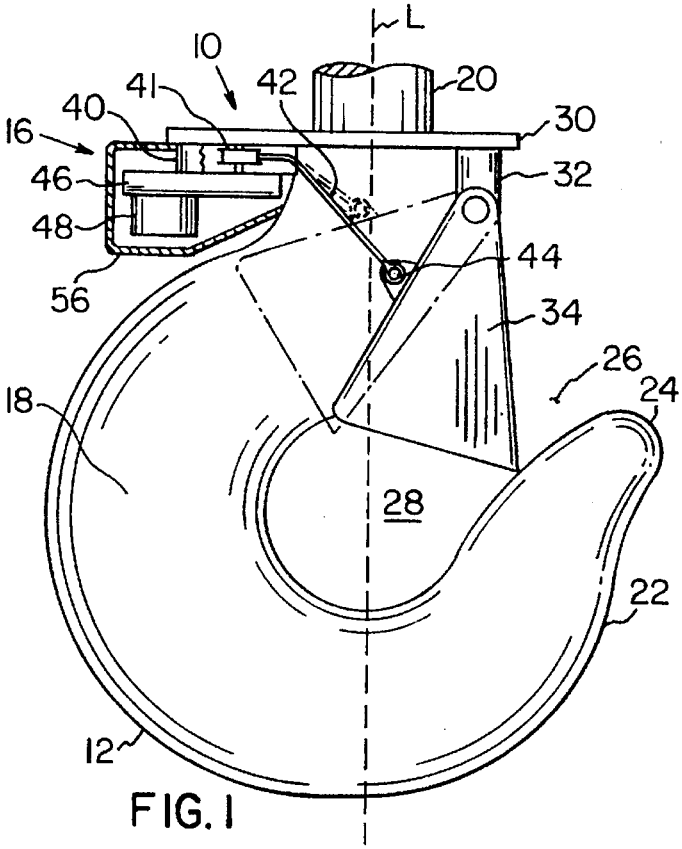
FIG. 1 is a broken side view of a hoist hook fitted with a first embodiment of a remote-controlled latch assembly.
Figure 2:
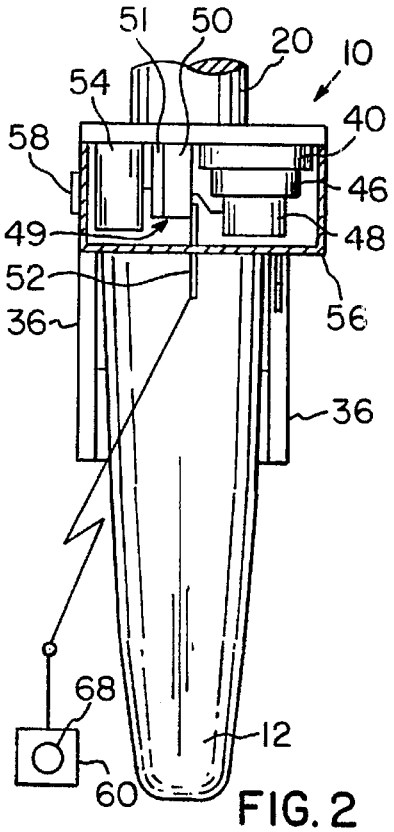
FIG. 2 is a broken rear view of the hook and latch assembly of FIG. 1.

A remote-controlled latch assembly of the present invention is generally designated 10 in FIGS. 1–7 of the drawings. FIGS. 1 and 2 show a hoist hook 12 fitted with a first embodiment of remote-controlled latch assembly 10. Hook 12 has a generally C-shaped body 18 with a substantially straight shank 20 located above body 18. Hook 12 also has an upwardly directed bill 22 terminating in an outwardly turned tip 24. Bill 22 is spaced from body 18 to form a throat 26 leading to an eye 28 of hook 12.

Latch assembly 10 includes a latch plate assembly having a substantially metal planar latch plate 30 carried in conventional manner, for example, by welding or bolting, on shank 20 above eye 28. Latch plate 30 is preferably mounted in a plane substantially perpendicular to a longitudinal axis L of shank 20. Latch plate 30 includes a pair of latch pivot blocks 32 attached to an underside of latch plate 30 forward of shank 20 and above bill 22. A gravity latch 34 is pivotally attached to latch pivot blocks 32 such that under normal circumstances, latch 34 hangs generally across throat 26 of hook 12 and is held in place by the force of gravity. Latch 34 is a generally U-shaped member having a flat outwardly-facing base and two triangular-shaped sides 36.

An operating assembly 16 is preferably disposed on the underside of latch plate 30 behind shank 20 and between latch plate 30 and hook body 18. Operating assembly 16 includes a substantially rectangular sheave assembly 40 housing a conventional rotatable sheave 41. Sheave assembly 40 is mounted in conventional manner, for example, by welding or bolting, to the underside of latch plate 30 behind shank 20. In the embodiments shown in FIGS. 1 and 2, sheave assembly 40 is mounted such that the axis of rotation of the sheave is substantially perpendicular to the plane of latch plate 30. A metallic, flexible cable 42 is carried on sheave 41 with a first end of flexible cable 42 attached to sheave 41 and a distal, second end of flexible cable 42 removably attached to an attachment element 44 on one side 36 of latch 34.

The second end of flexible cable 42 is removably attached to attachment element 44, for example, by a nut and bolt arrangement or a simple clip arrangement. A substantially rectangular, non self-locking, high reduction gear box 46 is attached to sheave assembly 40 such that an output element of gear box 46 is rotatably connected in conventional manner to sheave 41 in sheave assembly 40. Gear box 46 includes a set of conventional, interlocking, non-self locking reduction gears.

A drive motor 48 is connected to gear box 46 such that an output element of drive motor 48 engages the gears of gear box 46. Drive motor 48, gear box 46 and sheave assembly 40 are configured such that activation of drive motor 48 causes rotation of the gears in gear box 46 which in turn causes rotation of sheave 41 in sheave assembly 40. In the embodiment shown in FIGS. 1 and 2, gear box 46 is mounted below and in a plane substantially parallel to sheave assembly 40.

As shown in FIG. 2, operating assembly 16 further includes an electronics package 49 attached to the underside of latch plate 30 in proximity to sheave assembly 40 and in electronic communication with drive motor 48, for example, by wiring. Electronics package 49 includes a remote-controlled radio receiver 50 and an electronic latch control 51. Radio receiver 50 includes an antenna 52. An electrical power source is provided, such as a replaceable battery pack 54 disposed on the underside of latch plate 30 in proximity to, and in electronic communication with, electronics package 49, for example, by wiring. Battery pack 54 supplies electrical power to electronics package 49 and drive motor 48.

Operating assembly 16 is preferably surrounded by a housing 56 to protect the components thereof from possible damage during normal use. An aperture is provided in housing 56 so that a distal end of antenna 52 passes therethrough and protrudes outside housing 56. An additional aperture is provided for passage of flexible cable 42. Housing 56 further includes at least one access door 58 allowing easy access to the individual components of operating assembly 16. A portable radio transmitter 60 is located remote from, but within radio transmission range of, radio receiver 50.

Figure 3:
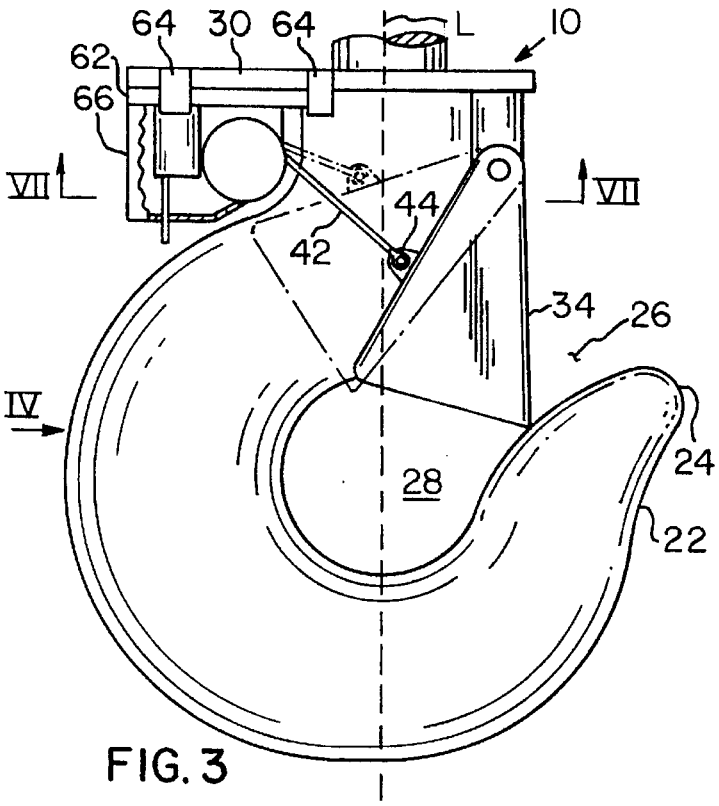
FIG. 3 is a broken side view of a hoist hook fitted with a second embodiment of the remote-controlled latch assembly.
Figure 4:
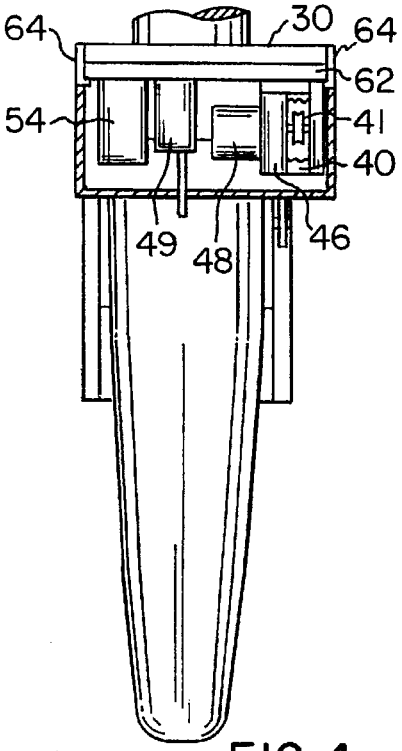
FIG. 4 is a broken rear view of the hook and latch assembly of FIG. 3.

A second embodiment of latch assembly 10 is shown in FIGS. 3 and 4. In the second embodiment, the latch plate assembly includes an attachment plate 62 removably disposed adjacent to the underside of latch plate 30. Attachment plate 62 is disposed in a plane substantially parallel to the plane of latch plate 30. Attachment plate 62 can be removably attached to the underside of latch plate 30, for example, by riding along shelf elements 64 and can be held in place by a conventional locking mechanism (not shown).

In the second embodiment, operating assembly 16 is carried on an underside of attachment plate 62 in like manner as the first embodiment of latch assembly 10 is carried on the underside of latch plate 30. However, the second embodiment of latch assembly 10 shown in FIGS. 3 and 4 differs from the first embodiment of latch assembly 10 shown in FIGS. 1 and 2 in that sheave assembly 40 is mounted to the underside of attachment plate 62 such that the axis of rotation of sheave 41 is substantially parallel to the plane of attachment plate 62. Gear box 46, with attached drive motor 48, is attached to the underside of attachment plate 62 adjacent to, and in mechanical engagement with, sheave assembly 40. Housing 56 is preferably mounted to latch plate 30 with a rear door 66 disposed in housing 56 such that attachment plate 62, containing operating assembly 16, can be slid into and out of housing 56 as a unit. Alternatively, housing 56 can be attached to attachment plate 62 such that attachment plate 62, operating assembly 16 and housing 56 can be engaged and disengaged from latch plate 30 as a unit.

Figure 5:
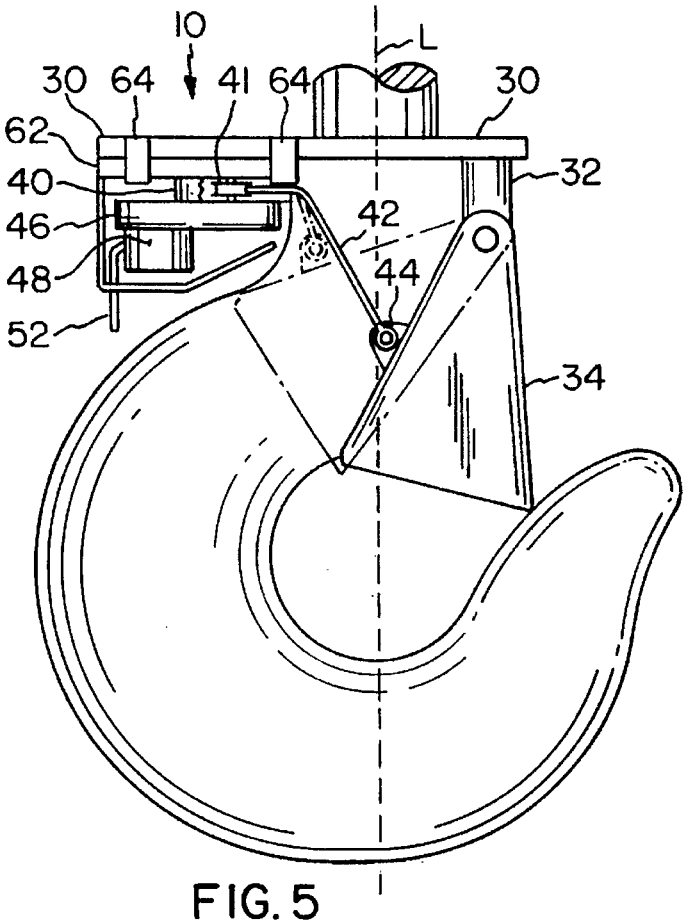
FIG. 5 is a broken side view of a hoist hook fitted with a third embodiment of a remote-controlled latch assembly.
Figure 6:
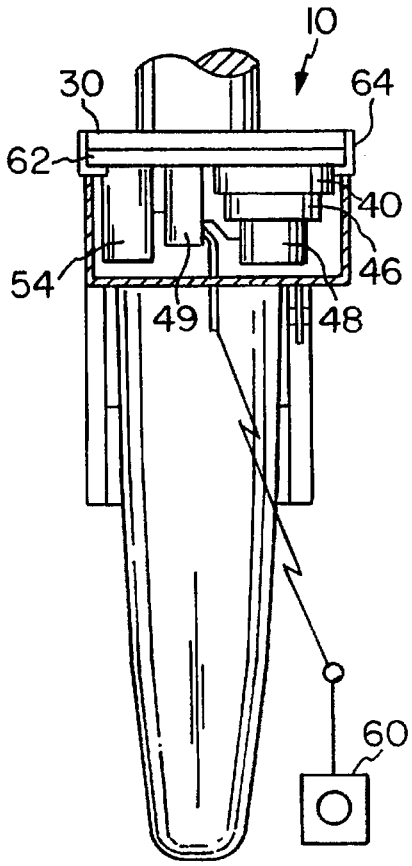
FIG. 6 is a broken rear view of the hook and latch assembly of FIG. 5.
Figure 7:
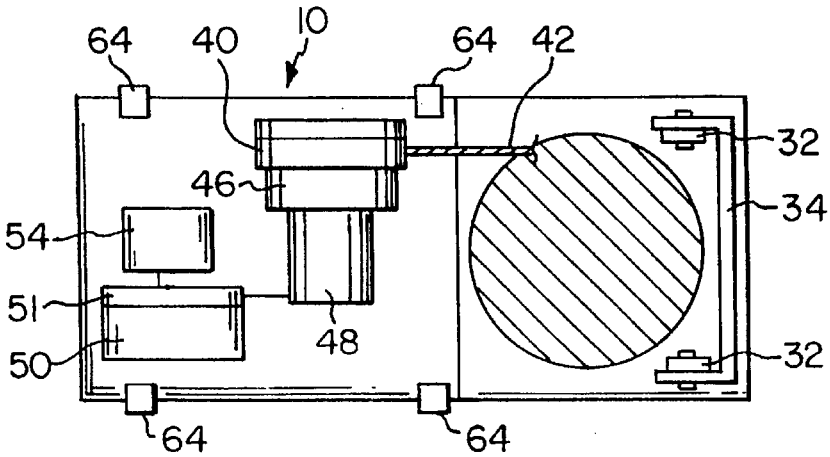
FIG. 7 is a broken bottom view of the hook and latch assembly of FIG. 3.

FIGS. 5 and 6 show a third embodiment of latch assembly 10. The third embodiment differs from the second embodiment in that control assembly 16 is carried on the underside of attachment plate 62 with sheave assembly 40, gear box 46 and drive motor 48 spatially arranged in a manner similar to that of the first embodiment shown in FIGS. 1 and 2.

Operation of latch assembly 10 will now be discussed. Each embodiment of latch assembly 10 operates in a similar manner. An operator actuates portable radio receiver 60, for example, by pressing an activation button 68. A signal from portable radio transmitter 60 is received by radio receiver 50 in electronics package 49 which in turn activates drive motor 48. Battery pack 54 provides the power supply for electronics package 49 and drive motor 48. Drive motor 48 causes rotation of the gears in gear box 46 in a first direction which causes rotation of sheave 41 in sheave assembly 40 in a first direction. Rotation of sheave 41 in the first direction causes flexible cable 42 to be retracted into sheave assembly 40 and to be wrapped around sheave 41. Retraction of flexible cable 42 causes latch 34 to pivot around latch pivot blocks 32 to a retracted position, as shown by dashed lines in FIGS. 1, 3 and 5, thus opening throat 26 of hook 12. Latch control 51 in electronics package 49 is used to set the "on" and "off" cycle times for motor 48 thus controlling the length of time latch 34 remains in the retracted position after activation of drive motor 48. These cycle times may be either preset (i.e., non-adjustable) or adjustable in duration. After the cycle time expires and drive motor 48 is deactivated, the force of gravity acting on latch 34 causes latch 34 to pivot around latch pivot blocks 32 back to its normal, closed position across throat 26 of hook 12. This is made possible due to the fact that the gears in gear box 46 are non-self locking and are freely rotatable in both directions.

Alternatively, electronics package 49 can be configured such that after drive motor 48 is activated and latch 34 is pulled into the retracted position, a second radio signal from portable radio transmitter 60 is required to be transmitted to radio receiver 50 to activate drive motor 48 and cause the gears in gear box 46 to rotate in a second direction causing flexible cable 42 to be paid out of sheave assembly 40 at a controlled rate, thus allowing latch 34 to pivot back across throat 26 of hook 12.

Thus, the operator can position latch 34 in the retracted position and automatically maneuver hook 12 away from the load without requiring workers to physically pivot latch 34 and manually remove the bail or shackle. Because the gears in gear box 46 are non-self locking, if operating assembly 16 experiences a loss of power so that remote-controlled operation of latch 34 is no longer possible, latch 34 can simply be operated in a manual manner until power is restored.

In the second and third embodiments of latch assembly 10 shown in FIGS. 3–6, operating assembly 16 can be removed and replaced as a unit by disengaging the second end of flexible cable 42 from attachment element 44, unlocking attachment plate 62 from engagement with latch plate 30, and then sliding attachment plate 62 rearward. This arrangement allows for fast and easy replacement of the entire operating assembly.

While embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of the appended claims and any and all equivalents thereof.

We claim:

1. A remote-controlled latch assembly for a hoist hook, comprising:

a latch plate attached to a shank of the hook;

a latch pivotally disposed across a throat of the hook; and a latch operating assembly removably carried on said latch plate, wherein said latch operating assembly includes:

a drive motor for causing said latch to pivot to an open position;

an electronics package disposed adjacent said drive motor and in electronic communication therewith, wherein said electronics package includes a radio receiver; and means for supplying electrical power to said electronics package and said drive motor, wherein said latch plate is substantially planar and wherein said latch plate lies in a plane substantially perpendicular to a longitudinal axis of the shank.

2. A latch assembly as claimed in claim 1, wherein said latch operating assembly further includes a sheave assembly having a rotatable sheave disposed therein.

3. A latch assembly as claimed in claim 1, wherein said latch operating assembly further includes a flexible cable carried on a sheave with a distal end of said cable attached to said latch.

4. A latch assembly as claimed in claim 1, wherein said latch operating assembly further includes a gear box attached to a sheave assembly having a sheave, such that rotation of gears in said gear box causes rotation of said sheave.

5. A latch assembly as claimed in claim 1, wherein said latch is a gravity latch.

6. A latch assembly as claimed in claim 1, further including a housing disposed around said latch operating assembly.

7. A latch assembly as claimed in claim 6, wherein said housing further includes an access door.

8. A latch assembly as claimed in claim 1, further including a portable radio transmitter.

9. A remote-controlled latch assembly for a hoist hook, comprising:

a latch plate attached to a shank of the hook;

a latch pivotally disposed across a throat of the hook; and a latch operating assembly removably carried on said latch plate, wherein said latch operating assembly includes:

a drive motor for causing said latch to pivot to an open position;

an electronics package disposed adjacent said drive motor and in electronic communication therewith, wherein said electronics package includes a radio receiver; and means for supplying electrical power to said electronics package and said drive motor, wherein said latch operating assembly further includes a gear box attached to a sheave assembly having a sheave, such that rotation of gears in said gear box causes rotation of said sheave, and wherein said gear box is a non self-locking, high reduction gear box.

10. A remote-controlled latch assembly for a hoist hook, comprising:

a latch plate attached to a shank of the hook;

a latch pivotally disposed across a throat of the hook; and a latch operating assembly removably carried on said latch plate, wherein said latch operating assembly includes:

a drive motor for causing said latch to pivot to an open position;

an electronics package disposed adjacent said drive motor and in electronic communication therewith, wherein said electronics package includes a radio receiver; and means for supplying electrical power to said electronics package and said drive motor, wherein said electronics package further includes a latch control for setting on and off cycle times for said drive motor.

11. A remote-controlled latch assembly for a hoist hook, comprising:

a latch plate attached to a shank of the hook;

a latch pivotally disposed across a throat of the hook; and a latch operating assembly removably carried on said latch plate, wherein said latch operating assembly includes:

a drive motor for causing said latch to pivot to an open position;

an electronics package disposed adjacent said drive motor and in electronic communication therewith, wherein said electronics package includes a radio receiver; and means for supplying electrical power to said electronics package and said drive motor, wherein said latch assembly further includes an attachment plate, wherein said latch operating assembly is disposed on said attachment plate and wherein said attachment plate is removably attached to said latch plate.

12. A latch assembly as claimed in claim 11, further including shelf elements disposed on said latch plate and wherein said attachment plate is configured to slide along said shelf elements.

13. A remote-controlled latch assembly for a hoist hook, comprising:

a planar latch plate attached to a shank of the hook, wherein said latch plate lies in a plane substantially perpendicular to a longitudinal axis of the shank;

a gravity latch pivotally connected to an underside of said latch plate, wherein in a closed position, said latch is disposed across a throat of the hook;

a portable radio transmitter; and a latch operating assembly carried on an underside of said latch plate, wherein said operating assembly includes:

a sheave assembly having a rotatable sheave disposed therein;

a flexible cable carried on said sheave, with a distal end of said flexible cable attached to said gravity latch;

a non self-locking, high reduction gear box attached to said sheave assembly such that rotation of gears in said gear box causes rotation of said sheave;

a drive motor connected to said gear box, wherein activation of said drive motor causes rotation of said gears;

an electronics package in electrical communication with said drive motor, wherein said electronics package includes a radio receiver and a latch control for setting on and off cycle times for said drive motor; and a battery pack in electronic communication with said electronics package for supplying electrical power to said electronics package and said drive motor.

14. A latch assembly as claimed in claim 13, further including a housing disposed around said latch operating assembly.

15. A latch assembly as claimed in claim 13, wherein said sheave assembly is disposed such that an axis of rotation of said sheave is substantially perpendicular to said plane of said latch plate.

16. A latch assembly as claimed in claim 13, wherein said sheave assembly is disposed such that an axis of rotation of said sheave is substantially parallel to said plane of said latch plate.

17. A latch assembly as claimed in claim 13, further including an attachment plate, wherein said latch operating assembly is disposed on an underside of said attachment plate, and wherein said attachment plate is detachably attached to said underside of said latch plate.

18. A latch assembly as claimed in claim 17, further including shelf elements attached to said latch plate and wherein said attachment plate slides along said shelf elements.

19. A latch assembly as claimed in claim 14, wherein said housing includes an access door.

20. A remote-controlled latch assembly for a hoist hook, comprising:

a latch plate assembly attached to the hook;

a latch pivotally disposed across a throat of the hook; and a latch operating assembly removably carried on said latch plate assembly, wherein said latch operating assembly includes:

a flexible cable having a distal end attached to said latch;

a drive motor configured to pull said flexible cable such that said latch is pivoted to an open position;

an electronics package in electronic communication with said drive motor, wherein said electronics package includes a radio receiver; and an electrical power source for supplying electrical power to said electronics package and said drive motor, wherein said latch plate assembly includes a latch plate attached to the hook and an attachment plate removably carried on said latch plate and wherein said latch operating assembly is attached to said attachment plate.

21. A latch assembly as claimed in claim 20, including shelf elements disposed on said latch plate, wherein said attachment plate is configured to slide along said shelf elements.

22. A latch assembly as claimed in claim 20, including a portable radio transmitter.

* * * * *